United States Patent [19]

Simpson

[11] 4,351,140

[45] Sep. 28, 1982

[54] END LAP SEAM CONSTRUCTION FOR STANDING SEAM ROOF PANELS

[75] Inventor: Harold G. Simpson, Oklahoma City, Okla.

[73] Assignee: The Wickes Corporation, San Diego, Calif.

[21] Appl. No.: 188,608

[22] Filed: Sep. 19, 1980

[51] Int. Cl.[3] ..... E04D 1/00

[52] U.S. Cl. ..... 52/542; 52/519; 52/394; 52/468

[58] Field of Search ..... 52/542, 519, 528, 395, 52/394, 403, 404, 468, 469, 478, 553, 588, 364, 309.2

[56] References Cited

U.S. PATENT DOCUMENTS

| | | | |
|---|---|---|---|
| 3,444,661 | 5/1969 | Santho | 52/364 |
| 3,508,368 | 4/1970 | Tischuk et al. | 52/394 |
| 3,606,718 | 9/1971 | Curran | 52/542 |
| 3,889,437 | 6/1975 | Day et al. | 52/528 X |
| 4,106,250 | 8/1978 | Cummings et al. | 52/394 |
| 4,139,974 | 2/1979 | Fox | 52/519 |
| 4,155,209 | 5/1979 | Schirmer | 52/468 |
| 4,196,554 | 4/1980 | Anderson et al. | 52/394 |

FOREIGN PATENT DOCUMENTS

| | | | |
|---|---|---|---|
| 1112579 | 11/1955 | France | 52/519 |

*Primary Examiner*—J. Karl Bell

*Attorney, Agent, or Firm*—Learman & McCulloch

[57] ABSTRACT

An end lap seam construction for metal roof panels in a standing seam roof is provided wherein a continuous water-tight seal extends around the entire periphery of each panel. Mating factory installed mastic strips are employed to seal the standing side seams of adjacent panels. The end lap seam of the present invention incorporates a mastic tape which may be field-applied without any great degree of precision to mate with and bond to the side seam mastic strip of an overlapping mating panel.

18 Claims, 9 Drawing Figures

END LAP SEAM CONSTRUCTION FOR STANDING SEAM ROOF PANELS

BACKGROUND OF THE INVENTION

In my copending application Ser. No. 183,717, filed Sept. 3, 1980, entitled "Roof Panel Assemblies For Forming Weather Standing Seams Joints And The Like and Methods of Joining Standing Seam Roof Panels", there is disclosed a standing seam roof construction wherein the sides of each roof panel are formed with a seam wall having a strip of factory-applied mastic located within a recess formed in the outer face of the seam wall. Two such panels are placed with their side walls in abutted face-to-face relationship with each other and an end cap strip seated over the upstanding walls of the adjacent panels is then deformed or squeezed inwardly by a seaming machine to clamp the walls against each other and to deform the mastic receiving recesses to squeeze the mastic into the space between the opposed wall portions of the respective panels. The consequent deformation of the end cap and wall portions mechanically lock the side edges of the two panels to each other.

While the seam construction disclosed in my copending application provides a greatly improved standing seam seal, it is also necessary to make provisions for the case where the dimension of the roof exceeds one panel length - in other words provision must be made for sealing the end edges of the panels as well as the side edges which are sealed by the standing seam.

The present invention is especially directed to an end lap seal for roof panels of the type disclosed in my aforesaid copending application in which a continuous peripheral seal is provided around the entire periphery of each roof panel and in which a field-applied mastic tape or strip, which does not have to be installed with any great degree of precision, may be installed to mate with and to bond to the factory installed mastic strip of the side seam of the panel.

SUMMARY OF THE INVENTION

In the standing seam of my aforesaid copending application, each longitudinal edge of the roof panel is preferably formed with a generally vertically upstanding wall section which is reversely bent downwardly on its inner side into a generally U-shaped configuration. The outer wall of this U-shaped edge is recessed and a factory installed bead of mastic is seated within this recess to extend the entire longitudinal length of the wall. The side seam is formed by placing the walls of the two adjacent panels in face-to-face relationship with each other, preferably spanning the abutted side edges of the two adjacent panels with a U-shaped elongate cap strip and then squeezing the legs of the U-shaped cap strip toward each other to deform the mastic containing recesses, thus spreading the mastic out over substantially the entire abutting faces of the two panels while mechanically locking the panels to each other.

To form an end lap seam with the foregoing construction, a notch is formed on the wall portion of that panel which will be the underlying panel in the lapped end seam by cutting the outer wall of the panel longitudinally above the mastic strip from the end of the panel inwardly for a distance slightly exceeding the overlap. This removes, over this portion of the panel, the inner web of the reversely bent portion of the wall so that the wall of the overlapping panel may be transversely seated within the notch thus formed with the outer face of the wall of the overlapping panel in engagement with the inner surface of the corresponding wall of the underlapped panel. A strip of mastic is placed on the underlying panel, parallel to the edge to be overlapped, and will be engaged with the mastic strip of the overlapping panel when the overlapping panel is seated upon the underlapping panel.

Other objects and features of the invention will become apparent by reference to the accompanying drawings and to the following specification.

IN THE DRAWINGS

Figure 1:
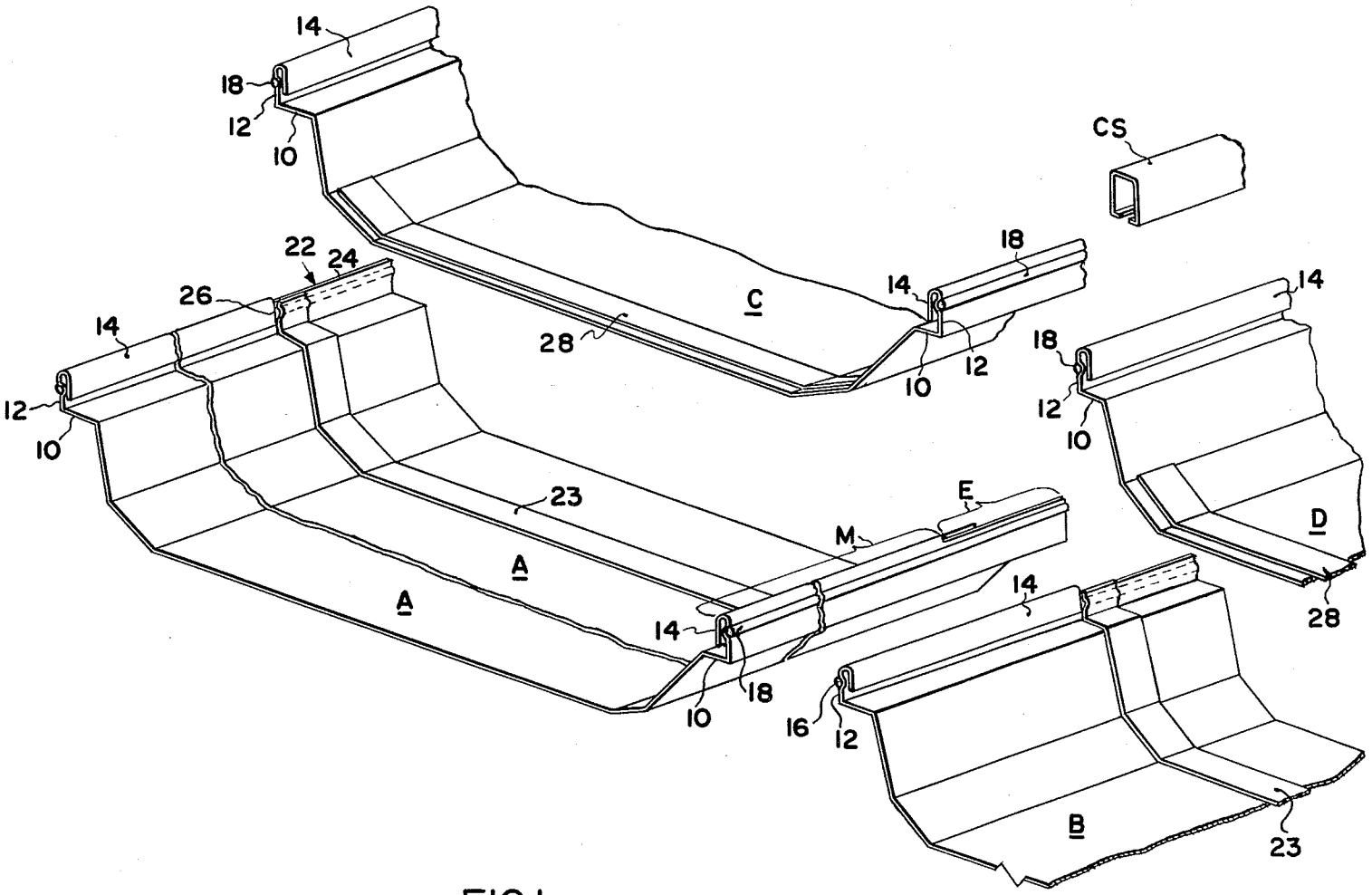
FIG. 1 is an exploded perspective view of a standing seam construction embodying the present invention.

Referring first to FIG. 1 there are shown in that figure portions of four separate roof panels A, B, C and D, and a portion of a cap strip CS employed in assembling the panels to each other. The longitudinal side edges of each of the panels A, B, C and D are formed with seam members 10 in accordance with the teachings of my aforesaid copending application into a cross-sectional configuration which includes a generally vertically upwardly projecting wall 12 which is reversely bent downwardly on its inner side as at 14 to form a generally U-shaped seam flange extending along the longitudinal side edges of the panel. The wall 12 is formed with a longitudinally extending recess 16 in its outer face, and this recess is filled with a bead of mastic sealing material 18, installed at the factory.

Figure 2:
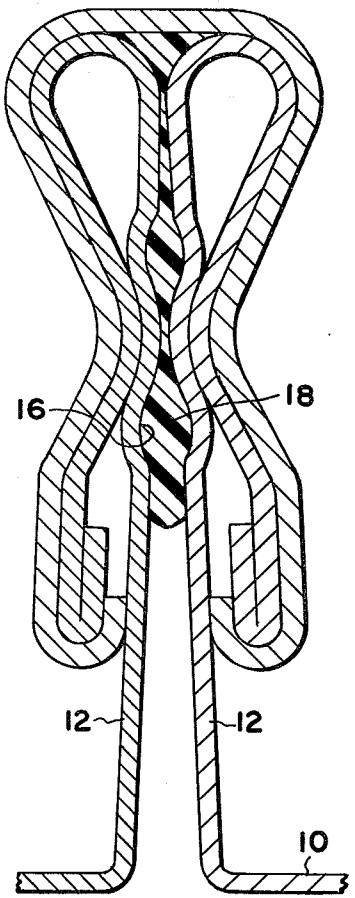
FIG. 2 is a cross-sectional view showing a completed standing seam as disclosed in my aforesaid copending application.

Referring now to FIG. 2, panels A and B are shown in cross-section as they would appear as if they had been joined to each other by a seam formed in accordance with the teachings of my aforesaid copending application. As compared to FIG. 1, the panels A and B have been moved together to place their walls 12 in contact with each other, a cap strip CS has been placed over the abutted walls and, by means of a seaming machine, the assembled panels and cap strip have been deformed as at 20, this deformation having collapsed the recess 16 to spread the mastic 18 between the abutted surfaces as indicated in FIG. 2.

Further details of the structure and assembly technique discussed broadly above may be had by reference to my aforesaid copending application.

It will be appreciated that the standing seam described thus far provides a highly efficient and effective seam for joining and sealing the longitudinal side edges of two adjacent roof panels to each other. However, it is believed also to be apparent that the seam, as described thus far, is not particularly well adapted for joining, in overlapping relationship, a second pair of panels in sealed end-to-end relationship with each other. The present invention is directed to that particular problem.

Referring first to FIG. 1, it is seen that the right-hand ends of panels A and B have been notched as at 22 by making a longitudinal cut in wall 12 from the end of the panel parallel to and above the mastic strip 18 to form an edge 24 and then transversely cutting through the inner web 14 to the edge 24 as at 26. The longitudinal extent of the notch—that is the length of edge 24—is selected to be equal to or slightly greater than the extent to which two panels are to be overlapped with each other in forming an end lapped seam. The notches 22 are formed on what is to be the underlapped end of the underlapping panel.

As compared to the uniform seam edge of my aforesaid copending application, the seam 10 may be said to consist of a main portion M (FIG. 1) of generally U-shaped cross-section and an integral endlap portion E which consists of an extension of the wall 12 only of the main portion M.

A strip of mastic tape 23 is placed upon the upper surface of panels A and B to extend transversely across the upper surface of the panels, parallel to their end edge from the edge 24 at one side of the panel to the edge 24 at the opposite side of the panel. Preferably, mastic tape 23 is located, as shown, fairly near the edge 26 of notch 22, but its precise location is not critical as long as the tape extends somewhere between a line joining the edges 26 on opposite sides of the panel and the adjacent edge of the panel. Thus, the tape 23 is well adapted to be applied in the field.

Figure 3:
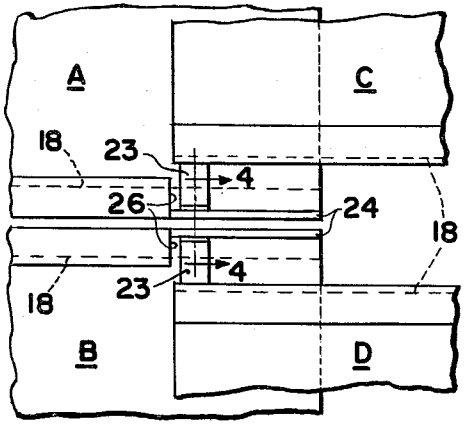
FIG. 3 is a top plan view of an end lap seam according to the present invention in an initial stage of the formation of the seam.

Referring now to FIG. 3, there is shown in top plan view a preliminary step in assembling four panels A, B, C, and D, together with panels A, B, and C, D being joined side-by-side to each other and the paired panels C, D being assembled into overlapping end-to-end relationship with panels A and B. In FIG. 3, panels A and B have been moved together into abutting side-by-side relationship with each other, while panels C and D are disposed in overlapping relationship respectively with panels A and B, but has not as yet been moved into abutting relationship with each other.

Figure 5:
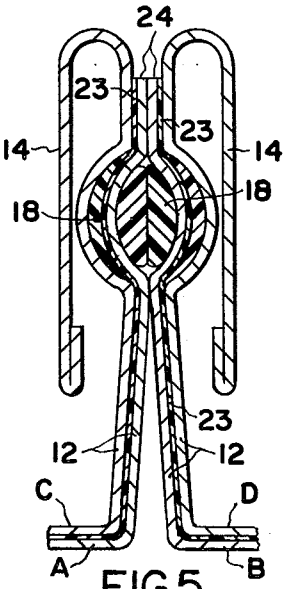
FIG. 5 is a cross-sectional view taken in the same plane as that of FIG. 4, showing the overlapping panels positioned ready for assembly.
Figure 4:
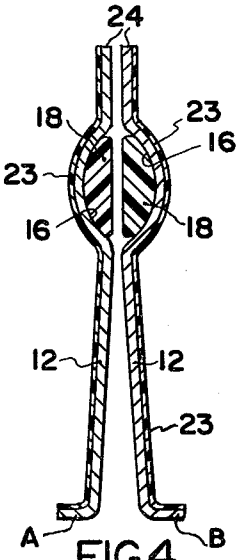
FIG. 4 is a detail cross-sectional view taken on the line 4—4 of FIG. 3, showing the underlying panels of the end lap seam in abutment with each other.

FIG. 4 shows a detail cross-sectional view of panels A and B as they are positioned in FIG. 3. In FIG. 5, the next successive step in the assembly is shown, with panels C and D now overlapped with panels A and B respectively, and panels C and D having been transversely moved from the position shown in FIG. 3 to that shown in FIG. 6. It will be noted from FIG. 5, that the mastic strip 23 is now not only clamped between panel A upon which it was mounted and the now overlapping panel C, but further that mastic strip 23 extends upwardly between the two now adjacent walls 10 of panels A and C, and more importantly tape 23 extends transversely across the longitudinally extending mastic strip 18 received within the recess of panel C. A similar relationship exists as to panels B and D.

Figure 6:
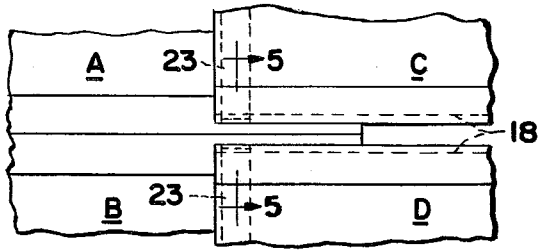
FIG. 6 is a top plan view, similar to FIG. 3, but showing the overlapping panels positioned as in FIG. 5.
Figure 7:
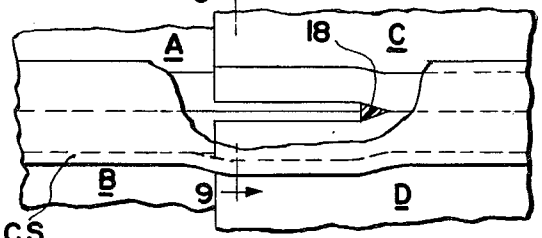
FIG. 7 is a top plan view of the completed end lap seam showing the cap strip in assembled position.
Figure 9:
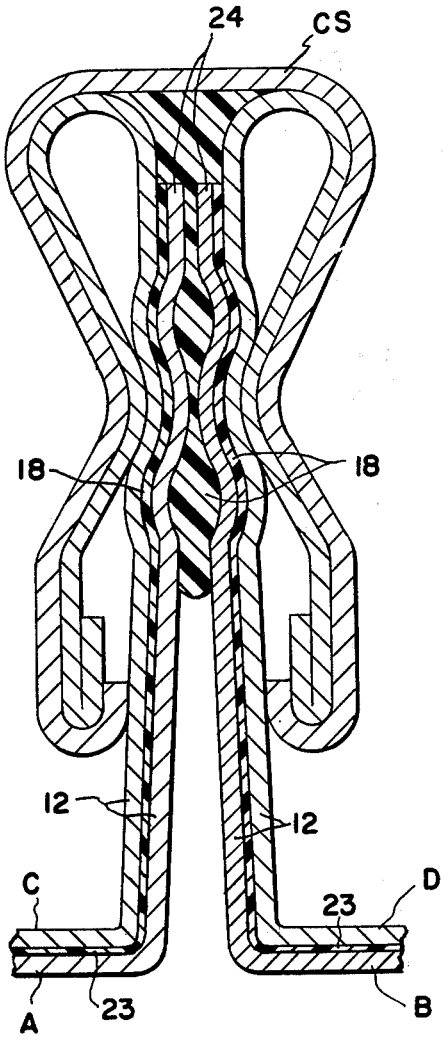
FIG. 9 is a cross-sectional view taken on the line 9—9 of FIG. 7.

When viewed from above, the panels are now in the position shown in FIG. 6, the next step of the assembly finds a cap strip CS, which extends the full length of the roof, being slipped downwardly over the longitudinally abutting seams and subsequently being deformed, in the same fashion as indicated in FIG. 2, by the seaming machine to mechanically clamp the assembled strips to each other and to deform the mastic. FIG. 9 shows a cross-sectional view of the thus completed joint.

Figure 8:
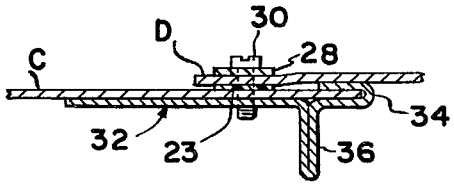
FIG. 8 is a cross-sectional view through an end lap seam showing a stiffening clip.

To assure a firm seal along the mastic tape 23 and the overlapping panels, a clinching strip 28 (FIGS. 1 and 8) may be mounted upon the overlapping panel to extend generally in overlying relationship to the mastic tape 23 and the two overlapped panels may be clamped firmly against each other as by a series of suitably located sheet metal screws 30 (FIG. 8).

If the end lapped seam described above is not located directly above a purlin or other underlying support, a stiffening strip 32 (see FIG. 8), which is long enough to overlie the purlin, is mounted along the overlapped edge of the underlapped panel as shown in FIG. 8. Stiffening strip 32 is formed with a generally U-shaped end edge as at 34 which wil slip over the end edge of the roof panel as shown in FIG. 8 and a stiffening web 36 formed by a reversely bent downwardly projecting web provides a stiffening factor along the end lap seam. The sheet metal screws 30 employed to clamp the overlapped panels together may extend, as indicated in FIG. 8, through the stiffening strip 32 to anchor the strip in position.

While one embodiment of the invention has been described in detail, it will be apparent to those skilled in the art that the disclosed embodiment may be modified. Therefore, the foregoing description is to be considered exemplary, rather than limiting, and the true scope of the invention is that defined in the following claims.

What is claimed is:

1. A generally rectangular standing seam roof panel having an upstanding seam member extending the entire length of at least one longitudinal side edge of said panel, said seam member including a longitudinally extending outer wall, a mastic waterproofing bead located on and extending the entire length of said wall at the outer side thereof, and means defining an endlap notch in said seam member at one end of said panel having a longitudinally extending notch edge located above said bead and below the top of said outer wall whereby two such panels may be disposed in overlapping end-to-end relationship with the outer side of the seam member wall of the overlapped panel nested in adjacent face-to-face relationship with the inner side of the wall of the underlapped panel in the region of said notch.

2. The invention defined in claim 1 further comprising means defining a recess in the outer side of said wall extending the entire length of said wall.

3. The invention defined in claim 2 wherein said mastic bead is disposed within said recess.

4. The invention defined in claim 1 further comprising a stiffening strip mounted upon and extending along the end edge of said panel at said one end thereof, said stiffening strip having a main web underlying said panel and an integral reversely bent upper web overlying said panel, and a stiffening web integral with and projecting downwardly from said main web.

5. In a standing seam roof assembly having a pair of generally rectangular prefabricated panels disposed in overlapped end-to-end relationship with each other; the improvement wherein each of said panels comprises an upstanding seam member including an outer wall extending the entire length of at least one longitudinal side edge of the panel, a mastic waterproofing bead located on and extending the entire length of the wall at the outer side thereof, means defining an endlap notch in the seam member of the underlying panel extending along the last mentioned seam member above the bead thereon for a distance equal to or slightly greater than the extent to which the overlying panel overlaps the underlying panel, the outer side of the wall of the overlying panel being located in adjacent face-to-face relationship with the inner side of the wall of the underlying panel below said notch.

6. The invention defined in claim 5 wherein each of said walls is upset inwardly to form a longitudinally extending recess in the outer side of said wall.

7. The invention defined in claim 6 wherein said mastic bead is disposed within and substantially fills said recess.

8. The invention defined in claim 7 wherein said mastic is a hot melt mastic.

9. The invention defined in claim 5 further comprising a strip of mastic located on the upper surface of said underlying panel and extending from said notch transversely across said underlying panel generally parallel to the end edge thereof.

10. The invention defined in claim 9 wherein the mastic bead of the overlying panel is compressed against the mastic strip of the underlying panel.

11. In a standing seam roof assembly made up of generally rectangular prefabricated roof panels; the improvement wherein each of said panels comprises an upstanding seam member extending along a side edge of the panel and including a generally vertical outer wall projecting upwardly from the panel at the side edge thereof, each wall having a continuous bead of mastic sealer extending the entire length of the outer side of the wall, a first pair of said panels being located in side-by-side relationship with the seam member walls thereof in opposed face-to-face relationship to each other, a continuous strip of mastic sealer extending transversely across the top of each of said first pair of panels and up the inner sides of the walls thereof in adjacent spaced relationship to one end edge of the respective panels, a second pair of said panels respectively located with one end edge thereof in overlapping face-to-face engagement with said one end edge and the mastic strip on the respective panels of said first pair, the outer sides of the walls of the panels of said second pair being located in overlapping face-to-face engagement with the inner sides of the walls of the panels of said first pair, and a continuous elongate cap strip of generally inverted U-shaped transverse cross-section enclosing and compressed against the inner sides of the walls of all of said panels to press said walls and the mastic beads thereon laterally against each other and to compress the mastic beads on said second pair of panels against the intersecting transversely extending mastic strips on said first pair of panels.

12. The invention as defined in claim 11 further comprising a metal strip extending transversely across the top of each of said second pair of panels in overlying relationship to the mastic strips on the underlying first pair of panels, and a plurality of threaded fastener means passing through and clamping said metal strip and the overlapping panels firmly together.

13. The invention defined in claim 12 further comprising a stiffening strip mounted upon and extending along the respective one end edges of said first pair of panels, each of said stiffening strips comprising a main web underlying the panel and an integral reversely bent upper web overlying the panel, and a stiffening web integral with and projecting downwardly from said main web, said main web underlying said mastic strip and said fastening means passing through and clamping said main web against the under side of the panel.

14. The invention defined in claim 12 wherein said seam members are of a generally inverted U-shaped transverse cross-section with said outer wall constituting one leg of the U-shaped cross-section, the seam members of said first pair of panels having an endlap notch therein extending from said one end edge of the respective panels to a point longitudinally beyond said mastic strip and defined by a longitudinal edge extending along the top of said outer wall and a transverse edge extending laterally from said longitudinal edge across the remainder of said seam member whereby the outer side of the wall of a panel of said second pair may engage the inner side of the wall of a panel of said first pair over the longitudinal extent of said notch.

15. The invention defined in claim 14 wherein the legs of the U-shaped cap strip are bent inwardly beneath the seam members of the respective panels.

16. In a generally rectangular standing seam roof panel of sheet metal material having an upstanding seam member integrally formed thereon and extending the entire length of at least one longitudinal side edge of said panel; the improvement wherein said seam member includes a main portion extending longitudinally along said side edge from one end edge of said panel to a lap location spaced longitudinally from the opposite end edge of said panel, a lap portion of said seam member extending from said main portion at said lap location to said opposite end edge of said panel, said main portion of said seam member being of a generally inverted U-shaped transverse cross-section and including a generally vertical outer wall projecting upwardly from said panel to define one leg of said U-shaped section, an inner web defining the other leg of said U-shaped section and spaced inwardly of said panel from said outer wall, the outer wall of said main portion of said seam member extending from said main portion beyond said lap location to define said lap portion of said seam member.

17. The invention defined in claim 16 wherein said outer wall has an outwardly concave offset portion defining a groove extending continuously longitudinally the entire length of the main and lap portions of said wall, and a continuous bead of waterproofing mastic substantially filling said groove.

18. The invention defined in claim 17 further comprising a strip of waterproofing mastic extending transversely across the top of said panel in spaced parallel relationship to said opposite end edge of said panel from the upper edge of said lap portion of said seam member.

* * * * *